US009718174B2

(12) United States Patent
Tsai

(10) Patent No.: US 9,718,174 B2
(45) Date of Patent: Aug. 1, 2017

(54) HAND TOOL ASSEMBLY WITH MAGNETIC SECURING DEVICE

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 110 days.

(21) Appl. No.: 14/924,716

(22) Filed: Oct. 28, 2015

(65) Prior Publication Data

US 2017/0120427 A1 May 4, 2017

(51) Int. Cl.
*B25B 23/12* (2006.01)
*B25B 15/00* (2006.01)
*B25B 23/00* (2006.01)

(52) U.S. Cl.
CPC ..... *B25B 23/12* (2013.01); *B25B 15/00* (2013.01); *B25B 23/0035* (2013.01)

(58) Field of Classification Search
CPC ..... B25B 13/06; B25B 23/02; B25B 23/10; B25B 23/101; B25B 23/103; B25B 23/105; B25B 23/106; B25B 23/108; B25B 23/12
USPC ..... 81/125, 438, 451
See application file for complete search history.

(56) References Cited

U.S. PATENT DOCUMENTS 3,288,185 A * 11/1966 Clark ..... B25B 23/10 81/451
3,392,767 A * 7/1968 Stillwagon, Jr. ..... B25B 23/12 7/165
6,530,299 B1 * 3/2003 Liu ..... B25B 23/12 81/125
9,156,147 B2 * 10/2015 Peters ..... B23B 31/10
9,227,309 B2 * 1/2016 Moss ..... B25B 23/0035
2009/0224492 A1 * 9/2009 Lin ..... B25B 15/001 279/82
2016/0311091 A1 * 10/2016 Wang ..... B25B 23/0035

* cited by examiner

*Primary Examiner* — Joshua Rodden

(57) ABSTRACT

A hand tool assembly with magnetic securing device includes a body, a sleeve, a collar and two resilient pieces. The body has a first space and a first groove. The sleeve has a first passage, a second space, a third space, a first distance and a fourth space. A magnetic part is located in the second space. A clip is engaged with the first groove and movable within the third space. A collar is secured in the fourth space to restrict the clip to prevent the body from dropping form the sleeve. The collar has two resilient pieces received therein and each resilient piece has a third engaging portion which contacts the outer periphery of the body to provide friction when the sleeve is moved relative to the body. A driving piece is connected to the body and drives a bolt or a screw which is attracted by the magnetic part.

6 Claims, 7 Drawing Sheets

C-C

C-C

HAND TOOL ASSEMBLY WITH MAGNETIC SECURING DEVICE

BACKGROUND OF THE INVENTION

1. Fields of the Invention

The present invention relates to a hand tool assembly with magnetic securing device, and more particularly, to a hand tool assembly with a magnetic securing device to prevent the object from slipping from the hand tool assembly.

2. Descriptions of Related Art

A slip-resistant magnetic sheath is disclosed in U.S. Pat. No. 7,107,882, and comprises a hollow sleeve that can be fit onto the screwdriver's shank. A magnetic part positioned at least on one end of the hollow sleeve, provides auxiliary attraction to improve the connection between the shank and the screw with a fastening rim and groove set correspondingly on the sleeve of the magnetic sheath and the shank. The groove allows the fastening rim to move within a pre-set distance so that the magnetic sheath can slide within certain distance and not fall off the shank. The invention installed on an electrical screwdriver can effectively address the slipping problem caused by shocking. The forceful magnetic attraction of the magnetic sheath can prevent the screws from slipping and therefore improve working efficiency.

However, there is no proper anti-slip device located between the magnetic sheath and the shank, so that when the magnetic sheath is slidably mounted to the shank, the magnetic sheath may slip along the shank. Although the magnetic part is snugly connected with the magnetic sheath, the magnetic part may be disengaged from the magnetic sheath during rotation of the magnetic part. The magnetic sheath has a smooth outer surface which is not convenient for the user to grape it firmly.

The present invention intends to provide a hand tool assembly with a magnetic securing device to eliminate the shortcomings mentioned above.

SUMMARY OF THE INVENTION

The present invention relates to a hand tool assembly and comprises a cylindrical body having a first groove defined in the outer periphery thereof. A hollow and cylindrical sleeve has a first passage defined axially therethrough, and the body extends through the first passage. A second space is defined in the first end of the sleeve. A third space and a fourth space are coaxially defined in the second end of the sleeve. The fourth space is located at the second end of the sleeve. The diameter of the third space is larger than that of the first passage, and the diameter of the fourth space is larger than that of the third space. A shoulder is formed between the third space and first passage. The second space has an inner groove defined in the inner periphery thereof. An axial distance of the third space is a first distance which is a maximum distance that the sleeve moves along the body. The sleeve has an anti-slip surface defined in the outer periphery thereof.

A ring-shaped first magnetic part is securely engaged with the second space and has a second passage which is located co-axially with the first passage. The first magnetic part has a flange on the outer periphery thereof and the flange is engaged with the inner groove in the second space. A first clip is engaged with the first groove and movable in the third space. A collar is securely engaged with the fourth space and restricts the first clip when the body extends through the sleeve so that the body does not slip out from the sleeve. The collar has a third passage defined therethrough and the body extends through the third passage. Four first engaging portions are located at the inner periphery of the third passage at even distance. A fifth space is defined between any two adjacent first engaging portions.

Two resilient pieces each have two second engaging portions and a third engaging portion which is connected between the two second engaging portions. The second engaging portions of each resilient piece is securely engaged with two of the four first engaging portions. The third engaging portion of each resilient piece is located within the fifth space and contacts the outer periphery of the body. A driving piece is connected to the first and second passages at the first end of the cylindrical body. The driving piece has a driving end which is located in the first and second passages. The driving end partially protrudes from the first magnetic part.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
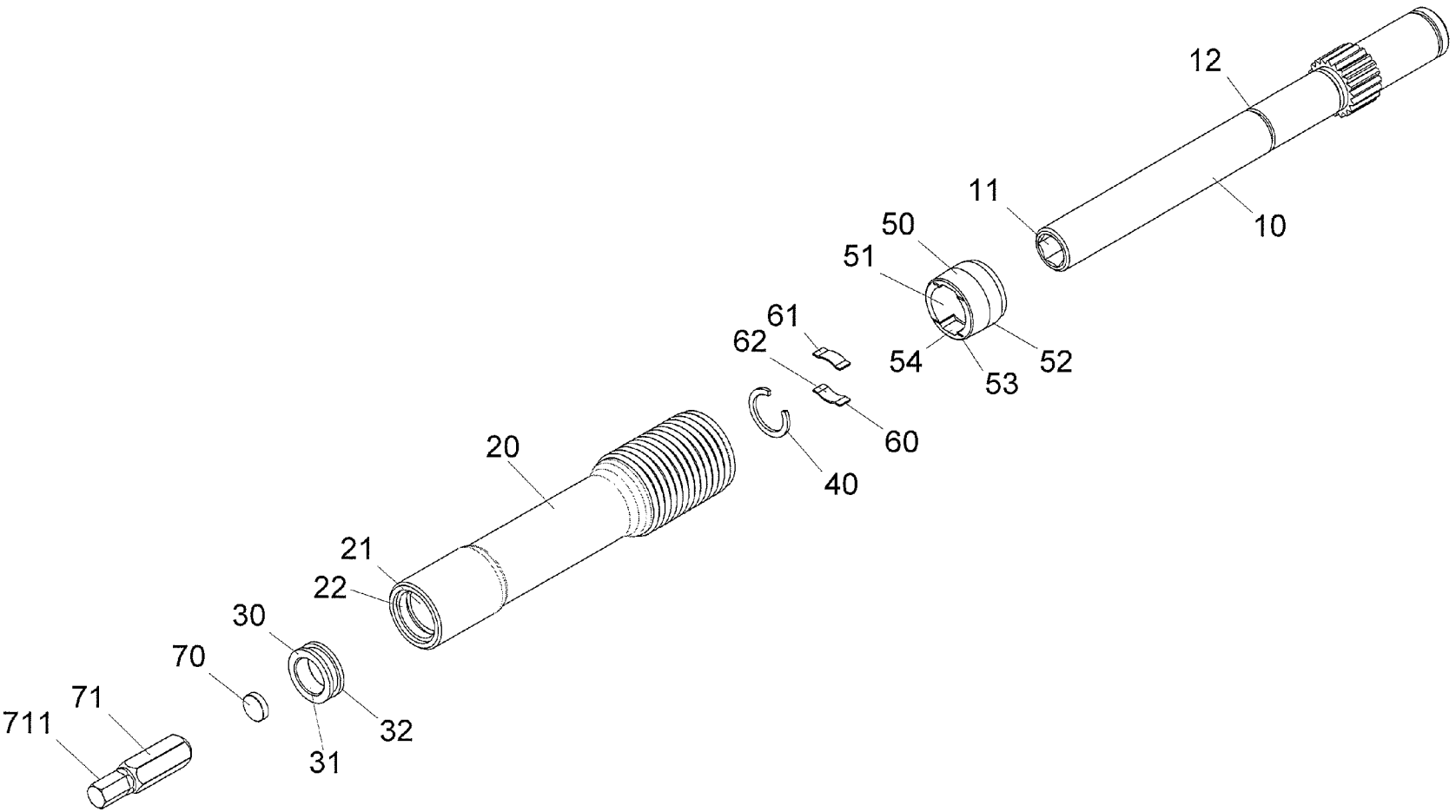
FIG. 1 is an exploded view of the hand tool assembly of the present invention.
Figure 2:
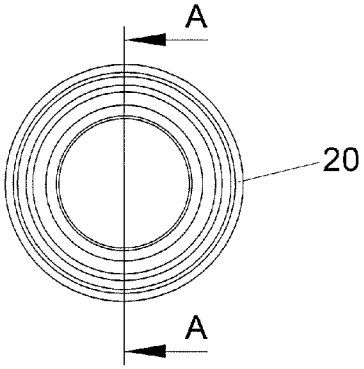
FIG. 2 is a front end view of the sleeve of the hand tool assembly of the present invention.
Figure 3:
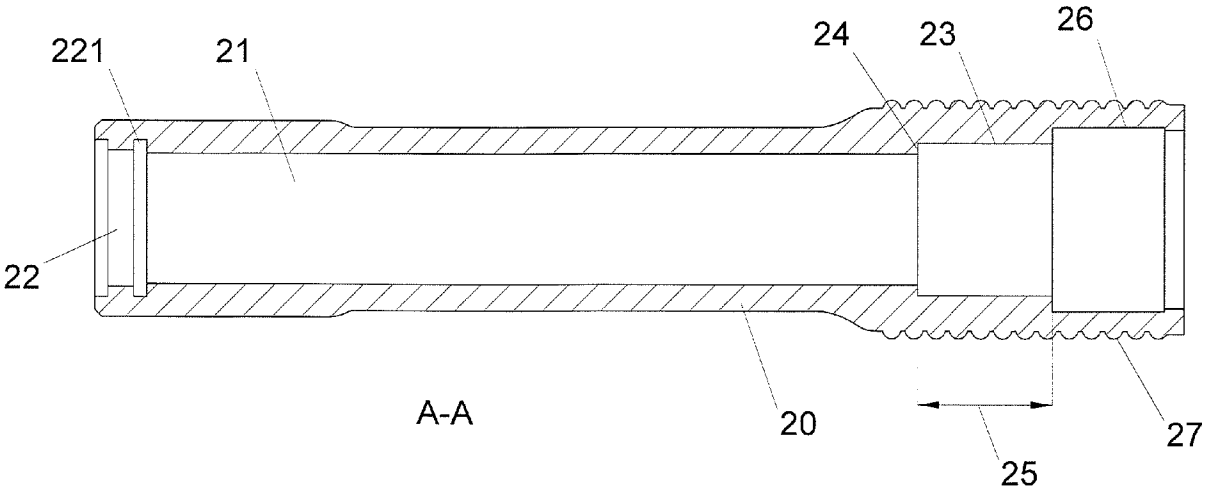
FIG. 3 is a side cross sectional view, taken along line A-A of FIG. 2.

Referring to FIGS. 1 to 3, the hand tool assembly of the present invention comprises a cylindrical body 10 having a first groove 12 defined in the outer periphery thereof. A hexagonal first space 11 is defined in the first end of the body 10 so as to receive a driving piece 71 inserted therein. The driving piece 71 is a hexagonal bit.

A hollow and cylindrical sleeve 20 has a first passage 21 defined axially therethrough, and the body 10 extends through the first passage 21. A second space 22 is defined in the first end of the sleeve 20, and a third space 23 and a fourth space 26 are coaxially defined in the second of the sleeve 20. The fourth space 26 is located at the second end of the sleeve 20. The diameter of the third space 23 is larger than that of the first passage 21 so as to define a shoulder 24 between the third space 23 and first passage 21. The diameter of the fourth space 26 is larger than that of the third space 23. The second space 22 has an inner groove 221 defined in the inner periphery thereof. An axial distance of the third space 23 is a first distance 25 which is a maximum distance that the sleeve 20 moves along the body 10. The sleeve 20 has an anti-slip surface 27 defined in the outer periphery thereof.

A ring-shaped first magnetic part 30 is securely engaged with the second space 22 and has a second passage 31 defined therethrough which is located co-axially with the first passage 21. The first magnetic part 30 has a flange 32 extending from the outer periphery thereof and the flange 32 is engaged with the inner groove 221 in the second space 22 such that the first magnetic part 30 does not drop from the second space 22.

A first clip 40 is engaged with the first groove 12 and movable in the third space 23.

A collar 50 is securely engaged with the fourth space 26 and restricts the movement of the first clip 40 when the body 10 extends through the sleeve 20 so that the body 10 does not slip out from the sleeve 20. Specifically, the collar 50 has an outer periphery 52 which is securely engaged with the inner periphery of the fourth space 26. The collar 50 has a third passage 51 defined therethrough and the body 10 extends through the third passage 51. Four first engaging portions 53 are located at the inner periphery of the third passage 51 at even distance. A fifth space 54 is defined between any two adjacent first engaging portions 53. The collar 50 can be threadedly connected with the fourth space 26 of the sleeve 20.

Two resilient pieces 60 each have two second engaging portions 61 and a third engaging portion 62 which is connected between the two second engaging portions 61. The second engaging portions 61 of each resilient piece 60 is securely engaged with two of the four first engaging portions 53. The third engaging portion 62 of each resilient piece 60 is located within the fifth space 54 and contacts the outer periphery of the body 10 so as to provide friction when the sleeve 20 is moved relative to the body 10. The third engaging portion 62 of each resilient piece 60 is a curved portion which is matched with a curvature of the outer periphery of the body 10.

The driving piece 71 is connected to the first and second passages 21, 31 at the first end of the cylindrical body 10, wherein the driving piece 71 has a driving end 711 which is located in the first and second passages 21, 31. The driving end 711 partially protrudes from the first magnetic part 30.

Figure 4:
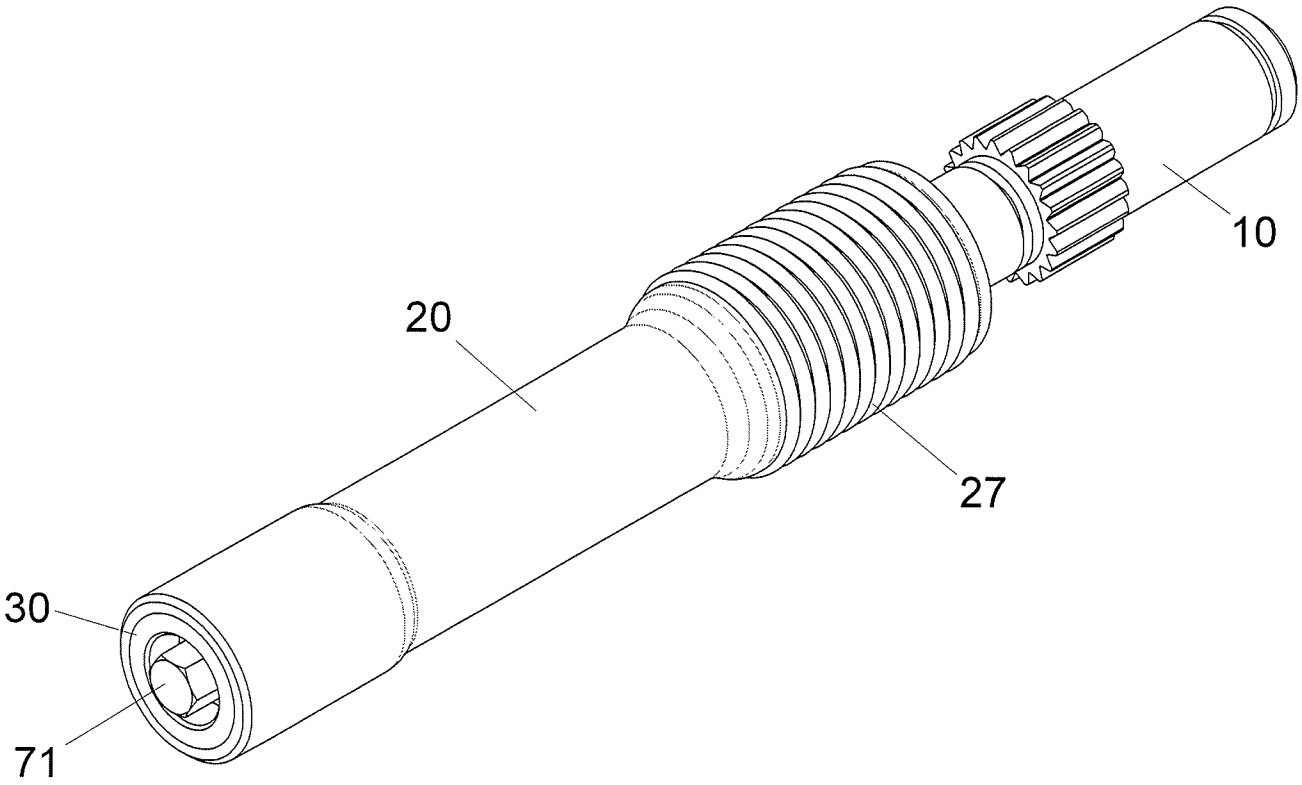
FIG. 4 is a perspective view to show the hand tool assembly of the present invention.
Figure 5:
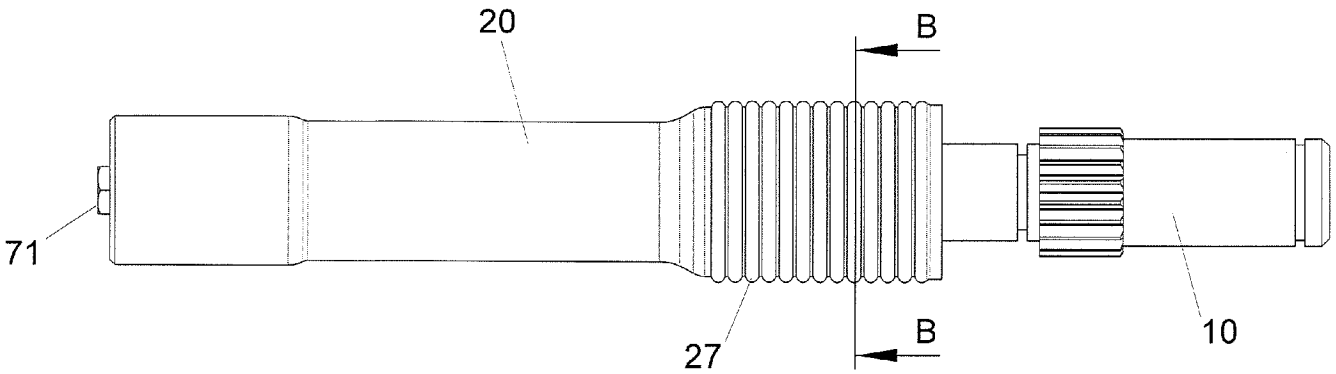
FIG. 5 is a side view to show the hand tool assembly of the present invention.
Figure 6:
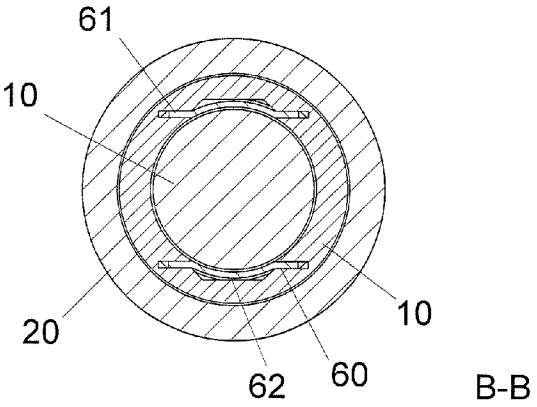
FIG. 6 is a side cross sectional view, taken along line B-B of FIG. 5.
Figure 8:
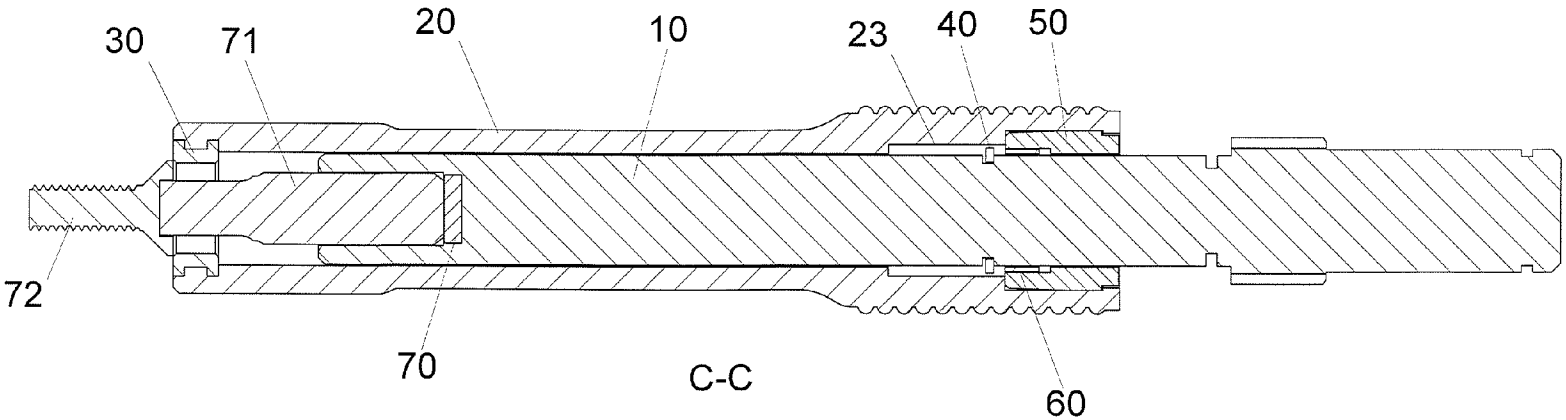
FIG. 8 is a side cross sectional view, taken along line C-C of FIG. 7.

As shown in FIGS. 4 to 6, when the body 10 extends through the sleeve 20, the body 10 extends through the first passage 21 and the third passage 51. The first magnetic part 30 is located in the second space 22 and engaged with the inner groove 221. The first clip 40 is engaged with the first groove 12 and the collar 50 is received in the fourth space 26 and located at the right side of the first clip 40 as shown in FIG. 8. The two resilient pieces 60 are engaged with the first engaging portions 53 and located in the fifth space 54 and provide friction when the sleeve 20 is moved relative to the body 10. The second magnetic part 70 is located in the first space 11. The driving piece 71 is received in the first space 11, the first passage 21 and the second passage 31.

Figure 7:
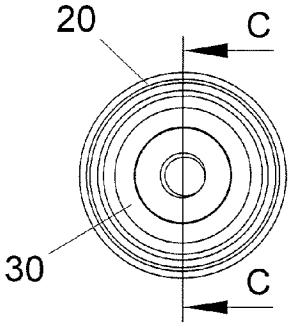
FIG. 7 is a front end view of the hand tool assembly of the present invention.

As shown FIGS. 7 and 8, when the user uses the driving piece 71 to rotate an object 72 such as a bolt or a screw, the driving end 711 is engaged with the object 72. The sleeve 20 is pulled to move the first clip 40 to be located between the third and fourth spaces 23, 26. The driving end 711 partially protrudes from the first magnetic part 30 which attracts the object 72 which is not separated from the driving end 711.

Figure 9:
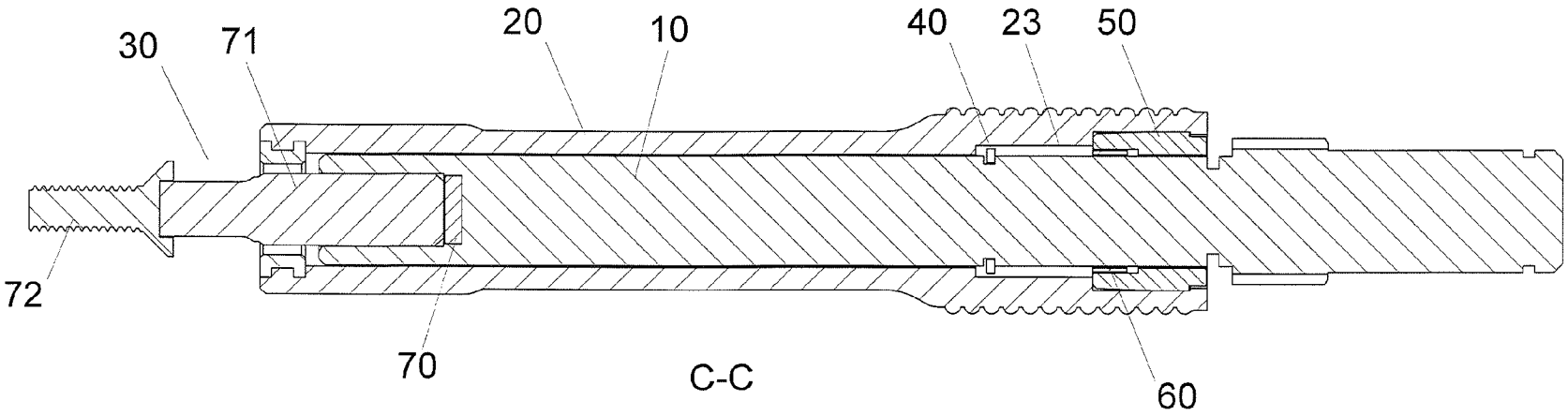
FIG. 9 is another side cross sectional view, taken along line B-B of FIG. 5, wherein the sleeve is pulled away from the driving piece.

As shown in FIG. 9, when the user wants to separate from the object 72 from the driving piece 71, the sleeve 10 is pulled to move the first clip 40 toward the shoulder 24, so that the driving end 711 completely protrudes from the first magnetic part 30. The object 72 is no longer attracted by the first magnetic part 30, so that the object 72 can be easily separated from the driving end 711.

Figure 10:
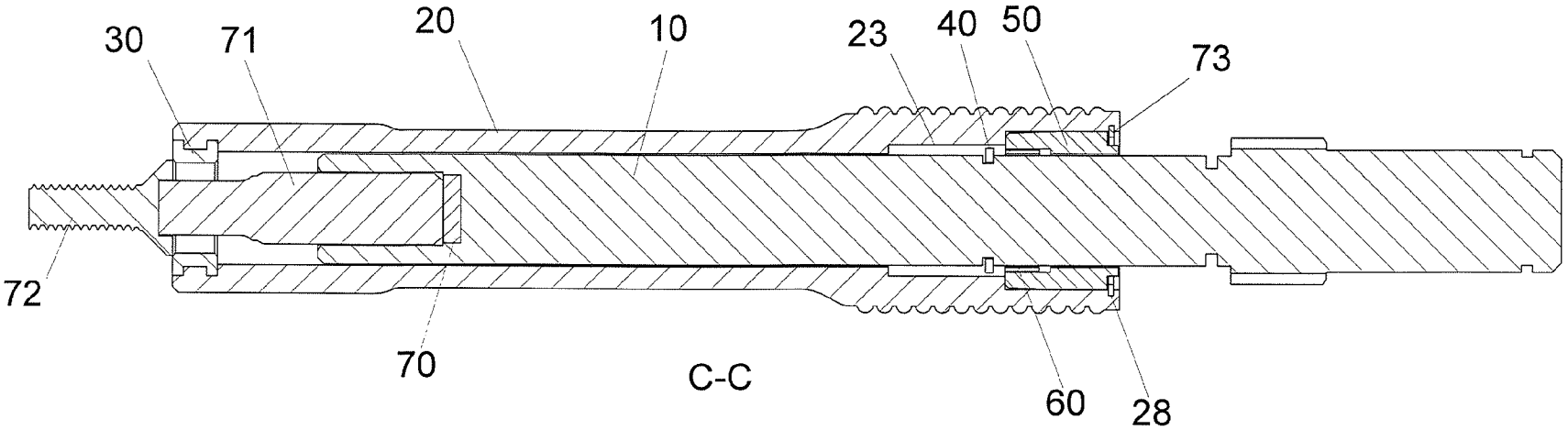
FIG. 10 is a side cross sectional view, taken along line B-B of FIG. 5 to show the second embodiment of the present invention.

As shown in FIG. 10, a second groove 28 is defined in the inner periphery of the fourth space 26, and a second clip 73 is engaged with the second groove 28. When the body 10 extends through the sleeve 20, the collar 50 is located in the fourth space 26 to restrict the collar 50. The second clip 73 is engaged with the second groove 28 and contacts the right end of the collar 50 as shown.

In another embodiment, the collar 50 has threads defined in the outer periphery 52 thereof. The fourth space 26 has threads defined in the inner periphery thereof. The threads of the collar 50 are threadedly connected to the threads of the fourth space 26.

The anti-slip surface on the sleeve 20 makes the user to easily hold and pull the sleeve 20 relative to the body 10 when operating. The object 72 is well attracted by the first magnetic part 30 so that the object 72 does not drop from the driving piece 71 when in use.

While we have shown and described the embodiment in accordance with the present invention, it should be clear to those skilled in the art that further embodiments may be made without departing from the scope of the present invention.

What is claimed is:

1. A hand tool assembly comprising:

a cylindrical body having a first groove defined in an outer periphery thereof;

a hollow and cylindrical sleeve having a first passage defined axially therethrough, the cylindrical body extending through the first passage, a second space defined in a first end of the sleeve, a third space and a fourth space coaxially defined in a second end of the sleeve, the fourth space being located at the second end of the sleeve, a diameter of the third space being larger than that of the first passage, a diameter of the fourth space being larger than that of the third space, a shoulder being formed between the third space and first passage, the second space having an inner groove defined in an inner periphery thereof, an axial distance of the third space being a first distance which is a maximum distance that the sleeve moves along the body, the sleeve having an anti-slip surface defined in an outer periphery thereof;

a ring-shaped first magnetic part securely engaged with the second space and having a second passage defined therethrough which is located co-axially with the first passage, the first magnetic part having a flange on an outer periphery thereof and the flange engaged with the inner groove in the second space;

a first clip engaged with the first groove and movable in the third space;

a collar securely engaged with the fourth space and restricting the first clip when the body extends through the sleeve so that the body does not slip out from the sleeve, the collar having a third passage defined therethrough and the body extending through the third passage, four first engaging portions located at an inner periphery of the third passage at even distance, a fifth space defined between any two adjacent first engaging portions;

two resilient pieces each having two second engaging portions and a third engaging portion which is connected between the two second engaging portions, the second engaging portions of each resilient piece securely engaged with two of the four first engaging portions, the third engaging portion of each resilient piece located within the fifth space and contacting the outer periphery of the body, and a driving piece connected to the first and second passages at a first end of the cylindrical body, the driving piece having a driving end which is located in the first and second passages, the driving end partially protruding from the first magnetic part.

2. The hand tool assembly as claimed in claim 1, wherein the collar has an outer periphery which is securely engaged with an inner periphery of the fourth space.

3. The hand tool assembly as claimed in claim 1, wherein the driving piece is a hexagonal bit which is inserted into a hexagonal first space defined in the first end of the body, a second magnetic part is located in the first space to attract the driving piece.

4. The hand tool assembly as claimed in claim 1, wherein a second groove is defined in an inner periphery of the fourth space and a second clip is engaged with the second groove, when the body extends through the sleeve, the collar is located in the fourth space to restrict the collar.

5. The hand tool assembly as claimed in claim 1, wherein the collar is threadedly connected with the fourth space of the sleeve.

6. The hand tool assembly as claimed in claim 1, wherein the third engaging portion of each resilient piece is a curved portion which is matched with a curvature of the outer periphery of the body.

* * * * *